United States Patent [19]

Campbell

[11] 4,129,098

[45] Dec. 12, 1978

[54] FLUIDIZED BEDS

[75] Inventor: John W. E. Campbell, London, England

[73] Assignee: Babcock & Wilcox Limited, London, England

[21] Appl. No.: 799,004

[22] Filed: May 20, 1977

[30] Foreign Application Priority Data

May 21, 1976 [GB] United Kingdom ..... 21050/76

[51] Int. Cl.[2] ..... F23D 19/02; F22B 1/02

[52] U.S. Cl. ..... 122/4 D; 110/245; 165/104 F

[58] Field of Search ..... 122/4 D; 110/8 F, 28 J; 432/58; 165/104 F, 106, 107

[56] References Cited

U.S. PATENT DOCUMENTS 3,805,715 4/1974 Keller ..... 110/8

3,961,903 6/1976 Nielsen et al. ..... 432/58

FOREIGN PATENT DOCUMENTS 282354 12/1970 U.S.S.R. ..... 165/104

*Primary Examiner*—Kenneth W. Sprague

*Attorney, Agent, or Firm*—Kemon & Estabrook

[57] ABSTRACT

This invention relates to fluidized bed furnaces. There is an increasing interest in furnaces in which the fuel is burned in a bed that is maintained in a fluent condition by combustion air supplied to the bed, and a fluid to be heated is passed through heat exchange tubes disposed within the bed. Interest has so far centered on the use of water as the fluid but this presents problems, especially at start-up and shut-down when it can be particularly difficult to ensure that the heat exchange tubes do not become dry and overheated.

8 Claims, 1 Drawing Figure

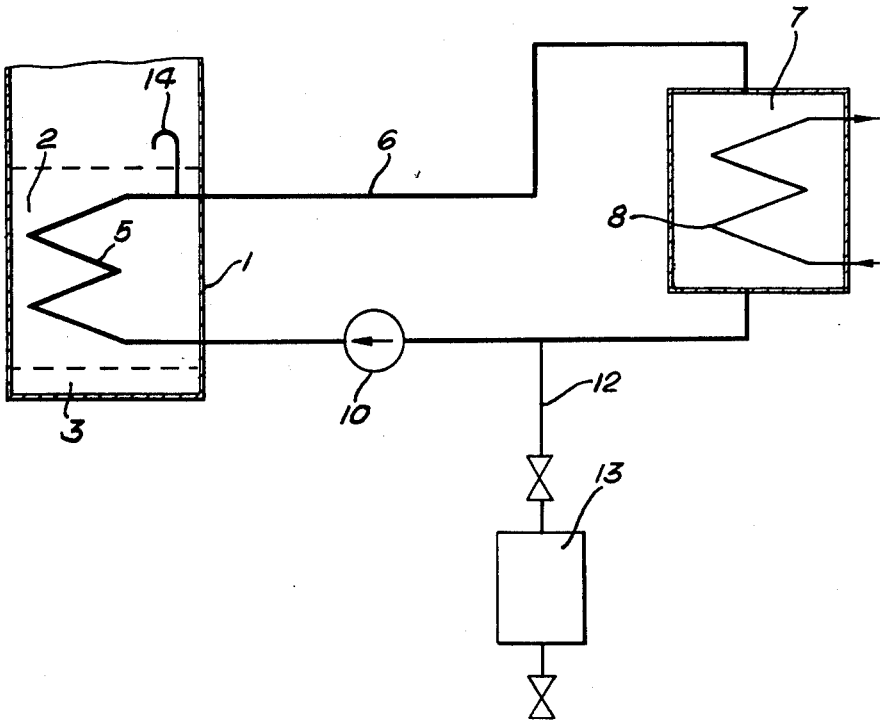
7
14
2
6
8
5
1
12
10
3
13

FLUIDIZED BEDS

The present invention is concerned to provide a novel way of using the heat in a fluidized bed furnace.

According to the invention, there is provided a fluid heating apparatus including a fluidized bed furnace, means defining an intermediate heat transfer loop comprising a heat absorbing section disposed within the fluidized bed and a further section in heat exchange with a heating flow path through which the fluid to be heated is passed in heat exchange with fluid flowing through the intermediate heat transfer loop, and means circulating through the intermediate heat transfer loop a stream of fine material carried in a gas.

According to the present invention there is also provided fluid heating apparatus including a fluidized bed furnace, means defining an intermediate heat transfer loop comprising a heat absorption section disposed within the fluidized bed and a further section included in a heat exchanger through which fluid to be heated may be passed in heat exchange with the further section, means by which a stream of fine material may be circulated through the loop in a stream of gas, and a bleed pipe leading from the loop through which fine material circulating through the loop may discharge.

By way of example, an embodiment of the present invention will now be described with respect to the a accompanying somewhat schematic drawing.

The apparatus shown in the drawing includes a fluidized bed furnace chamber 1 arranged for the burning of coal in a fluidized bed 2. A compressor (not shown) is provided to supply compressed combustion air to a plenum chamber 3 below the lower end of the bed so that the air flows from the chamber upwardly through the bed. A gas turbine (not shown) is arranged to be operated by the gases produced by combustion in the bed 2.

The chamber contains a tubulous coil 5 that is included in an intermediate heat transfer loop 6 and that during operation of the furnace lies immersed in the fluidized bed 2. Also included in the transfer loop, in series with the coil 5, is a drum 7 in which a coil 8 of a heating flow path lies, the drum and the heating coil serving in operation as a steam generating heat exchanger.

A circulator 10 is included in the intermediate heat transfer loop 6 between the tubulous coil 5 and the drum 7 and, immediately upstream of the circulator 10 there opens into the intermediate heat transfer loop 6 a duct 12 through which fine material carried in a stream of air can be introduced into the loop 6 from a replenishment system 13. A bleed, or equilibrium, pipe 14 leading from the intermediate heat transfer loop 6 at a location immediately downstream of the tubulous coil 5 opens into the furnace chamber 1 immediately above the fluidized bed 2.

To start up the apparatus that has been described fine material carried by a stream of air is introduced into the intermediate heat transfer loop 6 through the duct 12 and circulated through the loop by the circulator 10. At the same time, the fluidized bed 2 is brought into operation to generate heat. As the start-up process proceeds, the rate of introduction of fines increases until equilibrium is reached, and heat absorbed by the fines from the fluidized bed 2 is given up to the heating flow path 3 in the drum 7. During the circulation of the fine material, the pressure in the intermediate heat transfer loop 6 at the inlet end of the pipe 14 is slightly greater than the pressure in the furnace chamber 1 at the outlet end of the pipe 14. There is thus no risk of coarse material being sucked into the intermediate heat transfer loop 6 and any fine material that escapes through the bleed pipe 14 can easily be replaced. The provision of the bleed pipe 14 ensures that the pressure difference between the inside and outside of the tubulous coil 5 is small, so that only thin-walled tubes are needed for the coil.

At the shut down of the apparatus, the compressor and turbine close down very quickly with the result that the ambient pressure in the furnace chamber 1 falls very quickly. The pressure within the intermediate heat transfer loop 6 is thus such as to cause the fine material to be discharged quickly into the furnace chamber 1, but since the material is cheaply come by, its loss is not important, and since the bed is inert, the addition of the fine material to it has no harmful effect. An effect of the bleed pipe is to maintain the pressure in the intermediate heat transfer loop 6 the same as that in the furnace chamber 1 so that heating of the tubes will not cause intolerable pressures to occur within the loop 6. The components of the loop 6 will therefore not need to withstand pressure, and provided that the parts that lie in the fluidized bed 2 can withstand the temperature, there is no need for forced cooling of the bed which would waste heat and reduce the slump time i.e. the period during which a quick restart is possible after which the temperature of the bed is below instantaneous combustion temperature.

By provision of the bleed pipe 14 and the use as heat exchange medium of material that is cheaply expendable, the pressure in the intermediate heat transfer loop can easily be kept at a value low enough to enable thin walled tubes to be used. It is, however, envisaged that the pressure difference across the walls of the loop could be kept low enough under all conditions, without the use of a bleed pipe 14, by use of blow-down vessels, in which air and fine material is stored during shut down, compressors, valves and control equipment.

In a modification of what has been described, the bleed pipe leads from a location in the loop 6 between the circulator 10 and the coil 5 to the vicinity of the air being supplied to the bed, and opens into the plenum 3. With such a modification, the pressure drop in the coil 5 may be less, compared with the pressure drop in the bed 2, than would be expected in the arrangement shown in the drawing.

In other modifications of what has been described, the bleed pipe may lead from the loop at a location between the circulator 10 and the heating flow path 8, the position of the outlet end of the pipe being determined by the pressure drops in the loop 5 and the bed 2.

The fine material used in the auxiliary flow path may be material transferred directly from the fluidized bed, grits removed with the fines having first been removed or comminuted to be compatible with the rest of the fines. The degree of fineness must be assured to be appropriate to the circulator by which they are driven along the auxiliary flow path. In an alternative, the fines may be collected in a stock pile and drawn from that for use. The fine material used in the auxiliary flow path may contain finely ground limestone or dolomite which material may usefully be added to the fuel for the reduction of stack $SO_2$ emission.

What we claim is:

1. Fluid heating apparatus including a fluidized bed furnace, an intermediate heat transfer loop comprising a heat absorption section disposed within the fluidized bed and a further section, a heat exchanger providing two flow paths of which the first is said further section, means by which a fluid to be heated may be passed through the second of said flow paths, means by which a stream of fine solid material may be circulated through the loop in a stream of gas, and a bleed pipe leading from the loop through which fine solid material circulating through the loop may discharge.

2. Apparatus as claimed in claim 1 in which the gas in which the fine solid material is circulated passes through the loop at a pressure such that at any point in the heat absorption section, the internal pressure is greater than the external pressure.

3. Apparatus as claimed in claim 1 in which air inlets are provided at the lower end of the fluidized bed and the outlet end of the bleed pipe lies in the vicinity of the air inlets.

4. Apparatus as claimed in claim 1 in which the outlet end of the bleed pipe lies above the fluidized bed.

5. Apparatus as claimed in claim 4 in which the bleed pipe leads from the loop at the outlet end of the heat absorption section.

6. Apparatus as claimed in claim 4 in which the loop includes a circulator upstream of the heat absorption section and downstream of the heat exchanger, and the bleed pipe leads from the loop at a location between the circulator and the heat exchanger.

7. Apparatus as claimed in claim 6 in which the bleed pipe leads from the loop at the inlet end of the heat absorption section.

8. Apparatus as claimed in claim 6 in which the loop includes a circulator upstream of the heat absorption section and downstream of the heat exchanger, and the bleed pipe leads from the loop at a location between the circulator and the heat exchanger.

* * * * *